US005405141A

United States Patent [19]

Wilkes

[11] Patent Number: 5,405,141

[45] Date of Patent: Apr. 11, 1995

[54] FOOTBALL BOARD GAME APPARATUS AND METHOD OF PLAY

[76] Inventor: John M. Wilkes, 5303 Trail Lakes Dr., Houston, Tex. 77045

[21] Appl. No.: 151,834

[22] Filed: Nov. 15, 1993

[51] Int. Cl.[6] ..... A63F 3/00

[52] U.S. Cl. ..... 273/94; 273/284; 273/285

[58] Field of Search ..... 273/94, 285, 286, 247, 273/259, 277, 284

[56] References Cited

U.S. PATENT DOCUMENTS

| | | | |
|---|---|---|---|
| 343,496 | 6/1886 | Seliger | 273/284 |
| 1,499,905 | 7/1924 | Bishop | 273/94 R |
| 1,667,148 | 4/1928 | Farrell | 273/94 R |
| 1,699,132 | 1/1929 | Buchanan | 273/284 |
| 2,036,341 | 4/1936 | Lemburg | 273/148 R |
| 2,049,284 | 7/1936 | Anderson | 273/94 R |
| 3,103,361 | 9/1963 | Board | 273/94 R |
| 3,947,039 | 3/1976 | Sadler | 273/94 R |
| 4,173,346 | 11/1979 | Godwin | 273/94 R |
| 4,183,529 | 1/1980 | Hynson | 273/247 |
| 4,275,887 | 6/1981 | Tateyama | 273/284 |
| 4,606,554 | 8/1986 | Lederman | 273/284 |
| 4,773,650 | 9/1988 | Doughty | 273/247 |
| 5,213,326 | 5/1993 | Rundell | 273/269 |

*Primary Examiner*—Sebastiano Passaniti
*Attorney, Agent, or Firm*—Kenneth A. Roddy

[57] ABSTRACT

A football board game has a first game board with a football field depicted thereon and a second game board having indicator and scoring devices thereon. An offensive play option board has a plurality of offensive football play options imprinted on one surface representing actions to be used by an offensive team to advance the football and the yardage gained thereby and a selection device for selecting an offensive play option. A defensive play option board having a plurality of defensive football play options imprinted on one surface representing actions to be used by a defensive team to stop the offensive play options, to cause a loss in yardage, to change possession of the football, and to cause a turnover which allows the defensive team to score a touchdown, and selection devices for selecting a plurality of the defensive play options. In one embodiment, the game apparatus includes a binder member having ring fasteners and a pair of hinged cover panels with the game boards and play option boards releasably fastened within the binder. The game boards and play option boards may be formed of magnetically attractive material and the playing token and selection members formed of magnetic material, or the game boards and play option boards may be slotted and the playing token and selection member slidably engaged in the slots. The apparatus may also include a chance device and a storage pouch releasably fastened within the binder.

16 Claims, 9 Drawing Sheets

31

| OFFENSE | | |
|---|---|---|
| PASS 50 YDS | PASS 35 YDS | PASS 25 YDS |
| PASS 20 YDS | PASS 15 YDS 42 | PASS 10 YDS |
| RUN PITCH OUT 5 YDS | RUN DRAW PLAY 5 YDS | RUN OFF TACKLE 5 YDS |
| | | |

32

| DEFENSE | | |
|---|---|---|
| STOP PASS 50 YDS 43 | STOP PASS 35 YDS 43 | STOP PASS 25 YDS 43 |
| STOP PASS 20 YDS | STOP PASS 15 YDS | STOP PASS 10 YDS |
| STOP RUN PITCH OUT 5 YDS | STOP RUN DRAW PLAY 5 YDS 43 | STOP RUN OFF TACKLE 5 YDS |
| BLITZ AND/OR SACK DEFENSE<br>3 SELECTIONS ABOVE + 1 IN THIS SPACE = 10 YD LOSS<br>2 SELECTIONS ABOVE + 2 IN THIS SPACE = TURNOVER<br>1 SELECTION ABOVE + 3 IN THIS SPACE = TURNOVER, RETURN FOR TD | | |

FIG. 8

31

| OFFENSE | | |
|---|---|---|
| PASS 50 YDS | PASS 35 YDS | PASS 25 YDS |
| PASS 20 YDS | PASS 15 YDS | PASS 10 YDS |
| RUN PITCH OUT 5 YDS | RUN DRAW PLAY 5 YDS 42 | RUN OFF TACKLE 5 YDS |
| | | |

32

| DEFENSE | | |
|---|---|---|
| STOP PASS 50 YDS 43 | STOP PASS 35 YDS 43 | STOP PASS 25 YDS |
| STOP PASS 20 YDS 43 | STOP PASS 15 YDS | STOP PASS 10 YDS |
| STOP RUN PITCH OUT 5 YDS | STOP RUN DRAW PLAY 5 YDS 43 | STOP RUN OFF TACKLE 5 YDS |
| BLITZ AND/OR SACK DEFENSE<br>3 SELECTIONS ABOVE + 1 IN THIS SPACE = 10 YD LOSS<br>2 SELECTIONS ABOVE + 2 IN THIS SPACE = TURNOVER<br>1 SELECTION ABOVE + 3 IN THIS SPACE = TURNOVER, RETURN FOR TD | | |

FIG. 9

31

| OFFENSE | | |
|---|---|---|
| PASS 50 YDS 42 | PASS 35 YDS | PASS 25 YDS |
| PASS 20 YDS | PASS 15 YDS | PASS 10 YDS |
| RUN PITCH OUT 5 YDS | RUN DRAW PLAY 5 YDS | RUN OFF TACKLE 5 YDS |

32

| DEFENSE | | |
|---|---|---|
| STOP PASS 50 YDS 43 | STOP PASS 35 YDS | STOP PASS 25 YDS |
| STOP PASS 20 YDS 43 | STOP PASS 15 YDS | STOP PASS 10 YDS 43 |
| STOP RUN PITCH OUT 5 YDS | STOP RUN DRAW PLAY 5 YDS | STOP RUN OFF TACKLE 5 YDS |

BLITZ AND/OR SACK DEFENSE

3 SELECTIONS ABOVE + 1 IN THIS SPACE = 10 YD LOSS
2 SELECTIONS ABOVE + 2 IN THIS SPACE = TURNOVER
1 SELECTION ABOVE + 3 IN THIS SPACE = TURNOVER, RETURN FOR TD

43A

FIG. 10

31

| OFFENSE | | |
|---|---|---|
| PASS 50 YDS | PASS 35 YDS | PASS 25 YDS |
| PASS 20 YDS | PASS 15 YDS | PASS 10 YDS 42 |
| RUN PITCH OUT 5 YDS | RUN DRAW PLAY 5 YDS | RUN OFF TACKLE 5 YDS |

32

| DEFENSE | | |
|---|---|---|
| STOP PASS 50 YDS 43 | STOP PASS 35 YDS | STOP PASS 25 YDS |
| STOP PASS 20 YDS | STOP PASS 15 YDS | STOP PASS 10 YDS 43 |
| STOP RUN PITCH OUT 5 YDS | STOP RUN DRAW PLAY 5 YDS | STOP RUN OFF TACKLE 5 YDS |

BLITZ AND/OR SACK DEFENSE

3 SELECTIONS ABOVE + 1 IN THIS SPACE = 10 YD LOSS
2 SELECTIONS ABOVE + 2 IN THIS SPACE = TURNOVER
1 SELECTION ABOVE + 3 IN THIS SPACE = TURNOVER, RETURN FOR TD 43A 43B

FIG. 11

31

| OFFENSE | | |
|---|---|---|
| PASS<br>50 YDS<br>42 | PASS<br>35 YDS | PASS<br>25 YDS |
| PASS<br>20 YDS | PASS<br>15 YDS | PASS<br>10 YDS |
| RUN PITCH OUT<br>5 YDS | RUN DRAW PLAY<br>5 YDS | RUN OFF TACKLE<br>5 YDS |
| | | |

32

| DEFENSE | | |
|---|---|---|
| STOP PASS<br>50 YDS<br>43 | STOP PASS<br>35 YDS | STOP PASS<br>25 YDS |
| STOP PASS<br>20 YDS | STOP PASS<br>15 YDS | STOP PASS<br>10 YDS |
| STOP RUN PITCH OUT<br>5 YDS | STOP RUN DRAW PLAY<br>5 YDS | STOP RUN OFF TACKLE<br>5 YDS |
| BLITZ AND/OR SACK DEFENSE<br>3 SELECTIONS ABOVE + 1 IN THIS SPACE = 10 YD LOSS<br>2 SELECTIONS ABOVE + 2 IN THIS SPACE = TURNOVER<br>1 SELECTION ABOVE + 3 IN THIS SPACE = TURNOVER, RETURN FOR TD<br>43A | 43B | 43C |

FIG. 12

FOOTBALL BOARD GAME APPARATUS AND METHOD OF PLAY

BACKGROUND OF THE INVENTION

1. Field of the Invention

This invention relates generally to board games, and more particularly to a football board game apparatus carried in a looseleaf binder and method of play.

2. Brief Description of the Prior Art

Tyco Toys, Inc. of Mount Laurel, N.J. produces a line of sports games called "notebook games" including football, baseball, basketball, hockey, and bowling, which are designed to fit in a conventional three-ring looseleaf binder. Each game includes a rigid plastic gameboard, one or more pennies, and a launcher or "shooter" for propelling the penny to a target. In the football game, a penny represents the football. A spring loaded penny launcher is slidably mounted in a slot at one end of the gameboard and is moved manually from side-to-side by the offensive player. A "blocking" device having a slot capable of receiving the penny is slidably mounted at the opposite end of the gamboard and is moved manually from side-to side by the defensive player. The game played by the offensive player attempting to "shoot" the penny into a scoring area while the defensive player attempts to "block" or "catch" the penny. The offensive player has four attempts to gain 80 yards and score seven points for a touchdown, or a touchdown can be scored by shooting the penny into the end zone. Thus, the play action is more like a target game rather than realistic football strategy.

There are several patents on board games based on football, most of which utilize a conventional hinged game board with a playing field depicted thereon, sets of cards, dice and/or spinners. Some of these football games are overly complex and have complicated charts to provide a more realistic result to the various possible plays, and also take a great deal of time to play.

Heidbrink, U.S. Pat. No. 1,838,398 discloses a football game apparatus comprising a game board having a football field represented thereon, a plurality of spinners each having a surrounding circular series of concentric segments for giving the results of various plays, and a chart adjacent the spinners for identifying any particular one of the series of segments according to the play which is called for.

Sadler et al, U.S. Pat. No. 3,947,039 discloses a football game apparatus comprising a game board having a football field represented thereon and a playing piece movable therealong, an offensive play board having player selected columns representing offensive plays and chance selected rows intersecting with the columns to define offensive blocks, each containing yardage values, and a defensive play board having player selected columns representing defensive plays and chance selected rows intersecting with the columns to define defensive blocks, each containing yardage values. The values obtained in the selected offensive and defensive blocks are compared to determine the net yardage of each play and corresponding movement of the playing piece.

Cummins, U.S. Pat. No. 3,995,863 discloses a football game and teaching aid apparatus comprising a game board having a football field, score markers, down and quarter markers, ball position markers, and a reversible, invertible, slide indicator cooperating with the field representation which represents play moving from each end of the field and serves as a strategy selector for both offense and defense. Also included is an array of probability (chance) dial selectors to permit in-depth representation and operation of all the features and facets of football plays.

Godwin, U.S. Pat. No. 4,173,346 discloses a football game wherein a player is given the choice of running a play, a passing play, or a trick play, by selecting either to draw from a deck of cards or to roll a pair of dice. The wording on the cards and the use of the dice being statistically weighted to simulate the results of a conventional football game. The manner and use of the dices changes with changes in the condition of the game, and two decks of cards provide for two different conditions of the game.

Haffey, Jr., U.S. Pat. No. 4,003,580 discloses a football game apparatus comprising a game board having a football field represented thereon and a space at each end for run and pass options to be indicated thereupon, a ball position marker, a first down indicator, and individual down indicator, and two designation play markers. Two decks of cards provide a plurality of play situations for an offensive and defensive player. A multiplicity of down cards are controlled by the player starting on the offense while a multiplicity of kick cards are controlled by the defensive player. The offensive player chooses either a run or a pass and places a play designation marker on the board. The defensive player then attempts to anticipate the offensive play. The outcome is determined by comparing the offensive call with the defensive guess. Correct defensive guesses are statistically more favorable for the defensive player while incorrect defensive guesses favor the offensive player.

Hynson, U.S. Pat. No. 4,183,529 discloses a football game apparatus comprising a game board having a football field represented thereon, a plurality of defense instruction cards and offense instruction cards, a play result tabulation table inscribed on the game board for cooperating with a plurality of offense style cards and defense style cards. At the outset, the player determines a particular offense style to be used throughout the game. The offensive player may select a play of his own or use plays on the instruction cards. The offensive and defensive style cards corresponding to the play are each placed on the tabulation table and a direct reading corresponding to the two plays is taken from the table to determine the result of the play.

Rohme, U.S. Pat. No. 4,660,836 discloses a football game wherein the offense team chooses a play card and the defense team attempts to guess which play the offense. The degree of success in the attempt to guess is assessed. The degree of success together with a random number obtained by a selector are both used to locate the play result from a various probability result charts. The results are based on real events analogous to the degree of success the defense has in guessing what the offense will do.

Price, U.S. Pat. No. 4,706,959 discloses a football game apparatus comprising a game board having a football field represented thereon, a playing piece movable therealong representing the position of the player, a plurality of decks of cards each related to a specific type of play and the result of a selected play. The game board is also provided with indicia representing betting areas including means for indicating different possible outcomes of a play or series of plays.

The present invention is distinguished over the prior art in general, and these patents in particular by football board game which has a first game board with a football field depicted thereon and a second game board having indicator and scoring devices thereon. An offensive play option board has a plurality of offensive football play options imprinted on one surface representing actions to be used by an offensive team to advance the football and the yardage gained thereby and a selection device for selecting an offensive play option. A defensive play option board having a plurality of defensive football play options imprinted on one surface representing actions to be used by a defensive team to stop the offensive play options, to cause a loss in yardage, to change possession of the football, and to cause a turnover which allows the defensive team to score a touchdown, and selection devices for selecting a plurality of the defensive play options. In one embodiment, the game apparatus includes a binder member having ring fasteners and a pair of hinged cover panels with the game boards and play option boards releasably fastened within the binder. The game boards and play option boards may be formed of magnetically attractive material and the playing token and selection members formed of magnetic material, or the game boards and play option boards may be slotted and the playing token and selection member slidably engaged in the slots. The apparatus may also include a chance device and a storage pouch releasably fastened within the binder.

SUMMARY OF THE INVENTION

It is therefore an object of the present invention to provide a football board game which does not require a large game board, dice, cards, or charts.

It is another object of this invention to provide a football board game which eliminates cumbersome steps in the play action and allows a game to be played quickly.

Another object of this invention is to provide a football board game wherein the outcome of a play is based on the selection of offensive and defensive tactics by both teams.

Another object of this invention is to provide a football board game which does not require experience nor a knowledge of complicated plays for the enjoyment of the game.

Another object of this invention is to provide a football board game wherein the possibility of a succesful field goal attempt gradually increases relative to the closeness to the goal and does not require additional charts or data sheets.

Another object of this invention is to provide a football board game wherein all the players on each team can participate in the selection of offensive and defensive plays.

Another object of this invention is to provide apparatus for playing a board game wherein all the components may be stored in a looseleaf binder without interferring with the other functions of the binder.

Another object of this invention is to provide apparatus for playing a board game which is compact, easily transported, and can be stored in a small space on a shelf in the manner of a looseleaf binder.

A further object of this invention is to provide apparatus for playing board games wherein several game boards and various game pieces may be carried in a single binder for playing a variety of selected board games.

A still further object of this invention is to provide game board apparatus and a board game which is simple in construction, economical to manufacture, and attractive in appearance.

Other objects of the invention will become apparent from time to time throughout the specification and claims as hereinafter related.

The above noted objects and other objects of the invention are accomplished by a football board game which has a first game board with a football field depicted thereon and a second game board having indicator and scoring devices thereon. An offensive play option board has a plurality of offensive football play options imprinted on one surface representing actions to be used by an offensive team to advance the football and the yardage gained thereby and a selection device for selecting an offensive play option. A defensive play option board having a plurality of defensive football play options imprinted on one surface representing actions to be used by a defensive team to stop the offensive play options, to cause a loss in yardage, to change possession of the football, and to cause a turnover which allows the defensive team to score a touchdown, and selection devices for selecting a plurality of the defensive play options. In one embodiment, the game apparatus includes a binder member having ring fasteners and a pair of hinged cover panels with the game boards and play option boards releasably fastened within the binder. The game boards and play option boards may be formed of magnetically attractive material and the playing token and selection members formed of magnetic material, or the game boards and play option boards may be slotted and the playing token and selection member slidably engaged in the slots. The apparatus may also include a chance device and a storage pouch releasably fastened within the binder.

BRIEF DESCRIPTION OF THE DRAWINGS

FIGS. 8 through 12 are plan views of showing various selected plays using offensive and defensive play option boards of the game board apparatus.

DESCRIPTION OF THE PREFERRED EMBODIMENT

Figure 1:
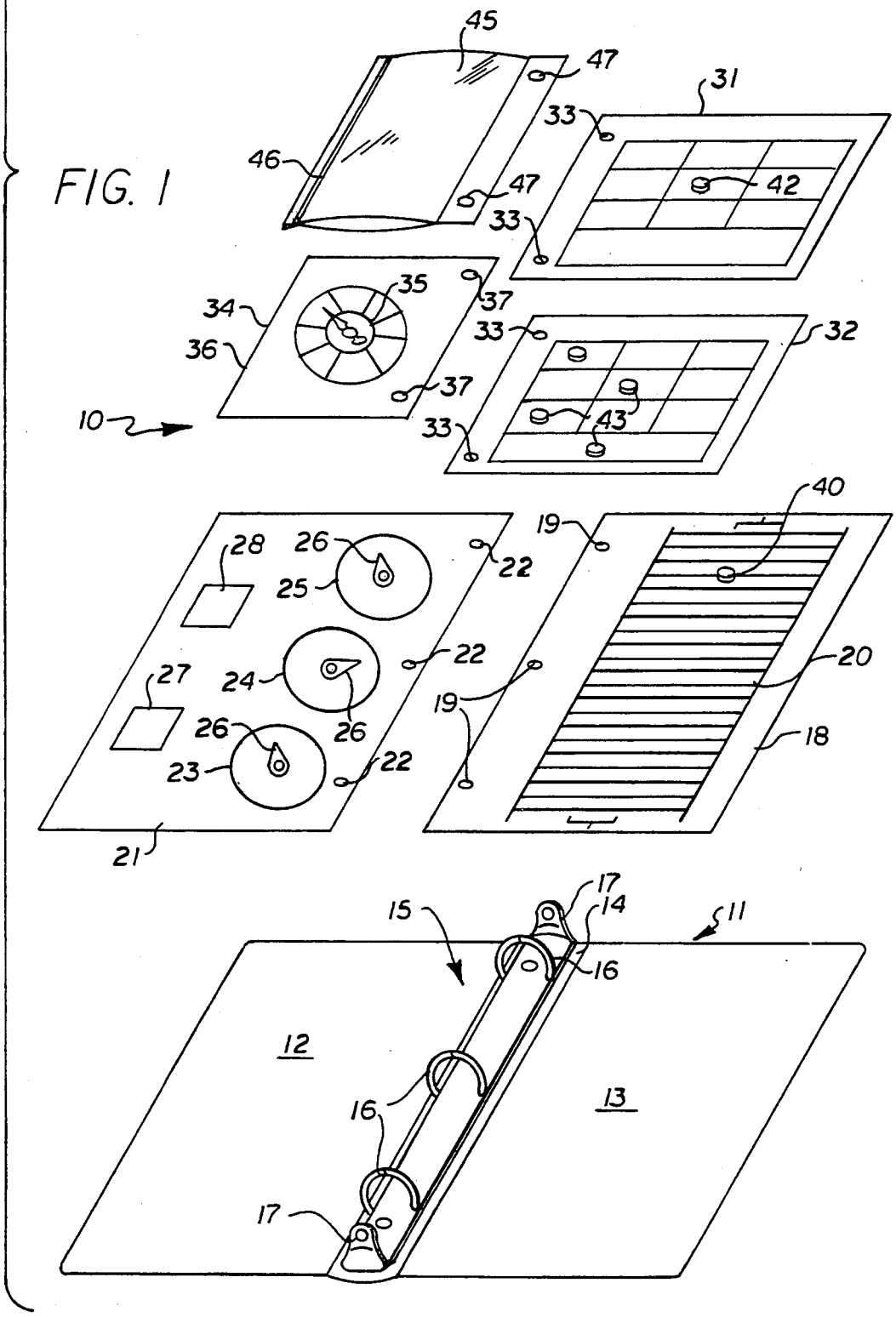
FIG. 1 is an exploded perspective view of the components of a preferred board game apparatus in accordance with the present invention.
Figure 2:
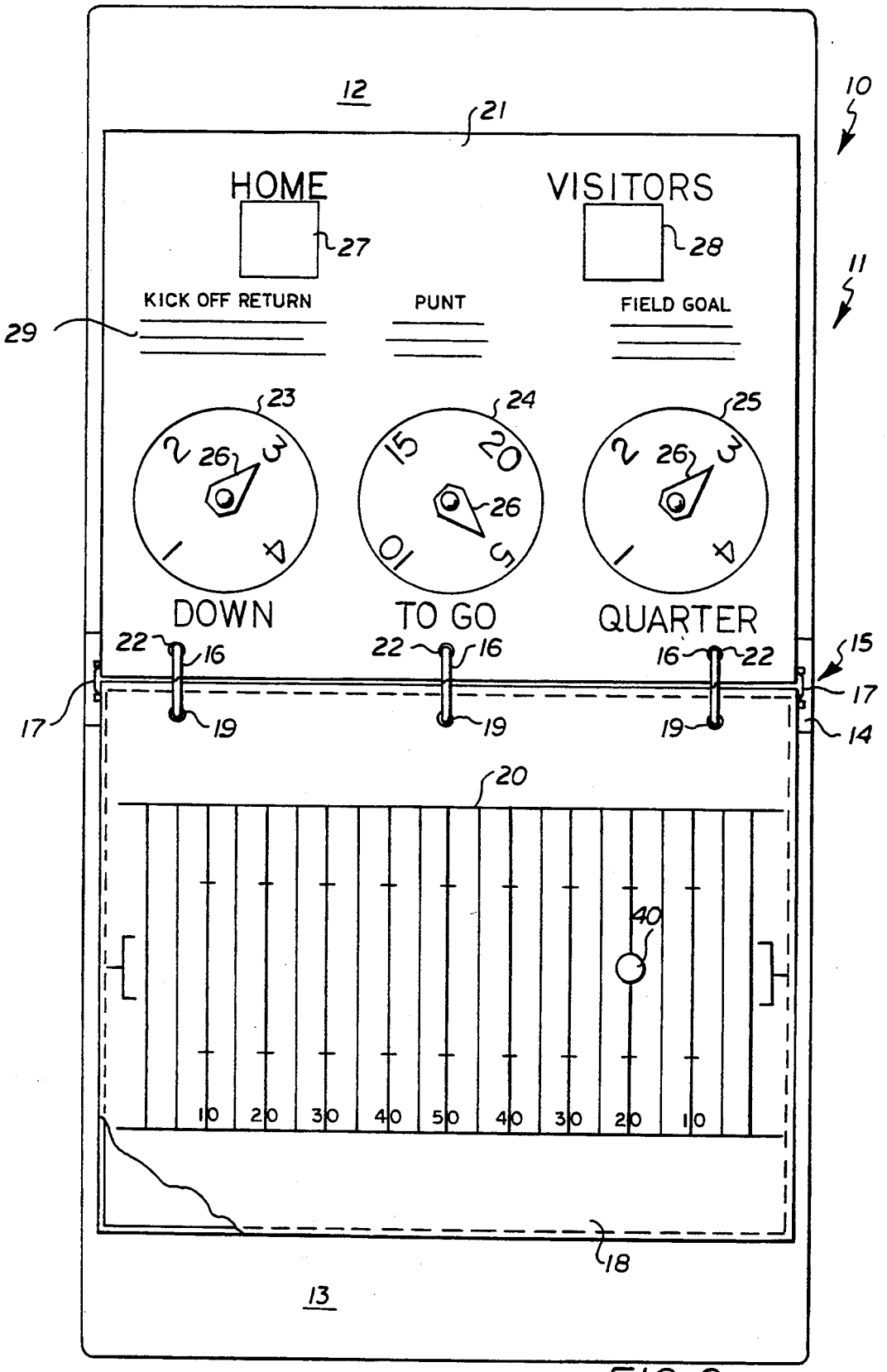
FIG. 2 is a top plan view the board game apparatus showing the binder in the open position with a game board based on a football theme fastened therein and opened for play of the game.

Referring to the drawings by numerals of reference, there is shown in FIGS. 1 and 2, a preferred board game system of apparatus 10 in accordance with the present invention. The board game apparatus 10 includes an outer cover or binder 11 which has two rectangular cover panels 12 and 13 hingedly secured to a rectangular back panel or spine 14. In the illustrated example, the binder 11 has a binder post assembly 15 including a plurality of binder rings 16 and a snap-action locking mechanism 17 for opening and closing the binder rings mounted on the backside of the spine 14. The binder 11 may be constructed of stiff reinforcing material, such as cardboard, sandwiched between vinyl sheets.

A thin, flat, rigid or semi-rigid game board member 18 having a plurality of apertures or holes 19 near one side edge corresponding to the spacing of the rings 16 of the binder 11 is received on the rings and releasably secured in the binder when the rings are closed. The game board 18 has a playing surface 20 imprinted on the outer surface for playing a game, for example, a football field. A thin, flat, rigid or semi-rigid complementary game board 21 having a plurality of apertures or holes 22 near one side edge is received on the rings 16 of the binder 11 in opposed relation to the game board 11. Thus, the game boards 18 and 21 are disposed face to face when the binder 11 is closed and when opened, the game boards 18 and 21 are opened to lie flat on each side of the rings 16 adjacent one another for carrying out the play of the game (FIG. 2).

The complementary game board 21 may be imprinted with various indicia or artwork to complement the game board 18. For example, as illustrated in FIG. 2, the complementary game board 21 is imprinted with indicia and indicators 23, 24, and 25 each having a rotatably mounted pointer 26 to indicate the "DOWN" 23, the number of yards "TO GO" 24, the "QUARTER" of play 25, score boxes for "HOME" 27 and "VISITORS" 28 representing each team, and instructions 29 for carrying out the play of the game, such as rules concerning "KICK-OFF RETURN", "PUNT", and "FIELD GOAL". Depending upon the material used to construct the complementary game board 21 (described below), the players can mark the score on the surface of the game board 21 with erasable pens or markers. Paper pads may also be secured to the surface of the game board for keeping score.

Figure 3:
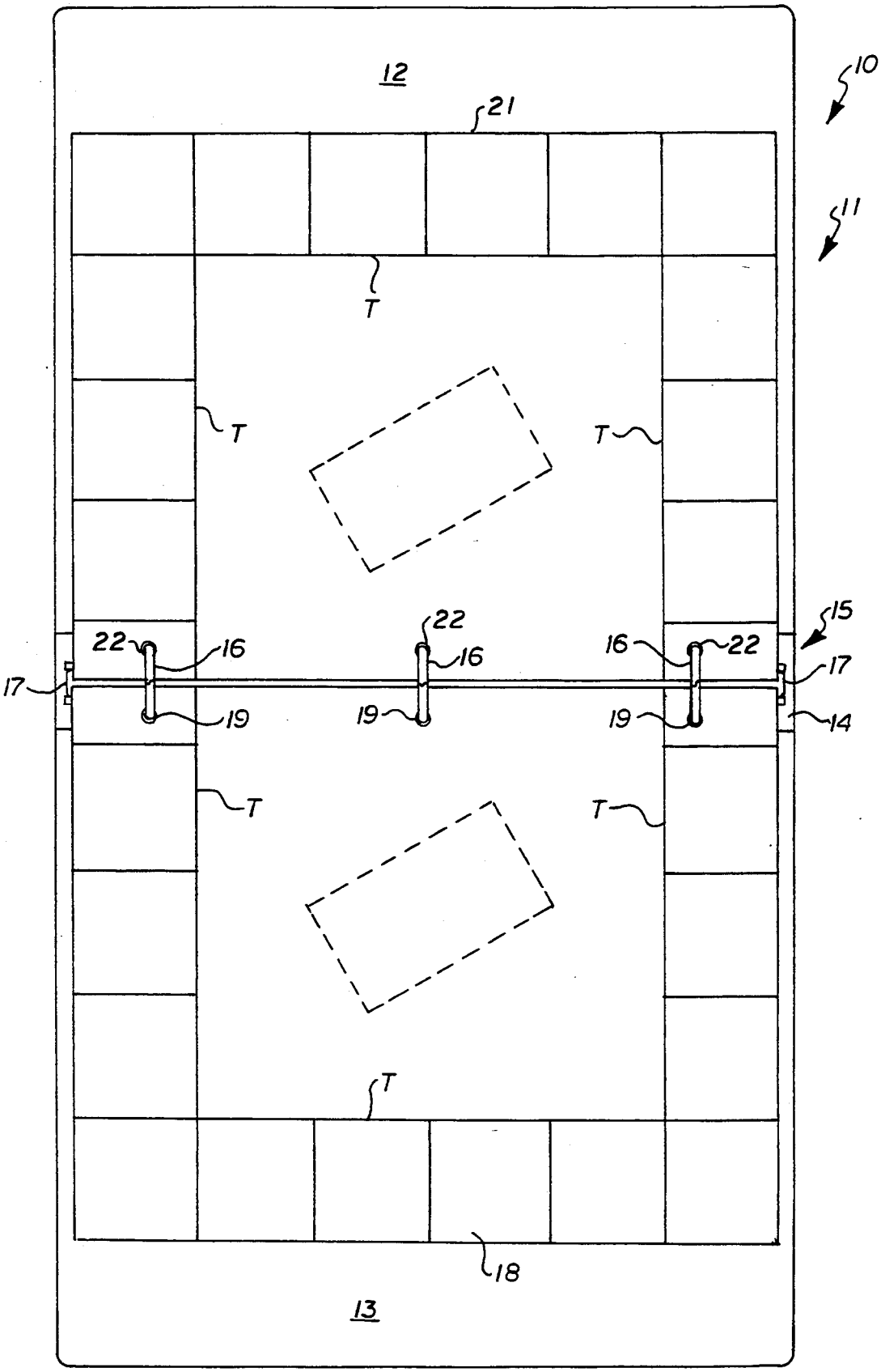
FIG. 3 is a top plan view the board game apparatus showing the binder in the open position with a typical game board having a path fastened therein and opened for play of the game.

As shown in FIG. 3, the complementary game board 21 may also be imprinted to form an extension or continuation of the playing surface on the adjacent game board 18 in various other types of games, such as those having a path or track T, etc., on which tokens are moved.

Additional thin, flat, rigid or semi-rigid game play boards 31 and 32 having indicia imprinted thereon and a plurality of apertures or holes 33 near one side edge corresponding to the spacing of the rings 16 of the binder 11 may be releasably received on the rings and removed for carrying out the play of the game. For example, in the illustrated football game embodiment, an "OFFENSE" huddle board 31 and a "DEFENSE" huddle board 32 are provided.

Figure 4:
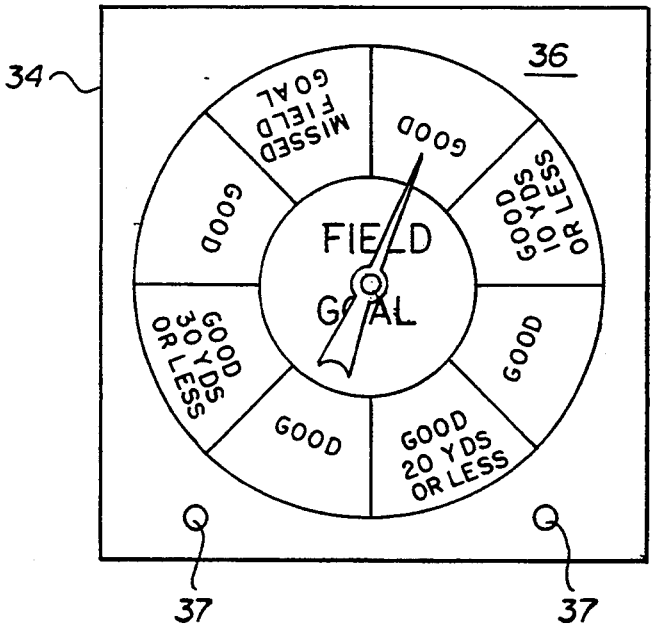
FIG. 4 is a top plan view of a spinner member of the board game apparatus.

As shown in FIGS. 1 and 4, a spinner 34 may also be provided for play of the game wherein the spinner pointer 35 is rotatably mounted on a thin, flat, rigid or semi-rigid board 36 having indicia imprinted thereon and a plurality of apertures or holes 37 near one side edge corresponding to the spacing of the rings 16 of the binder 11 such that it is releasably received on the rings and removed for carrying out the play of the game. Other types of game playing equipment, such as an electronic random number generator, calculator, sound device, etc., may also be mounted on thin, flat, rigid or semi-rigid boards and removably installed on the rings 16 of the binder 11 and removed for carrying out the play of the game.

Figure 5:
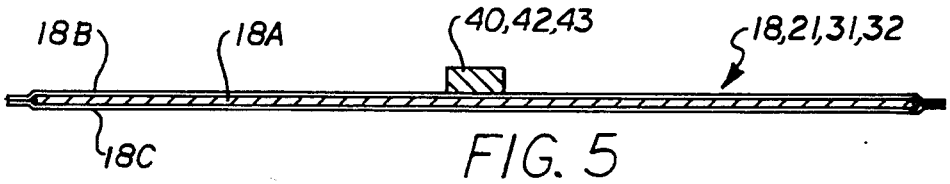
FIG. 5 is a cross section through a magnetic game board member of board game apparatus.

As seen in FIG. 5, in a preferred embodiment, the game board 18 is constructed of a sheet of magnetically attractive material 18A sealed between two sheets of vinyl material 18B and 18C, or between one ply of vinyl material and a sheet of cardboard, whereby a flat token 40, representing a football, formed of magnetic material may be movably attached to the outer surface and moved along the playing surface during play of the game. The complementary game board 21 and game play boards 31 and 32 may also be constructed of a sheet of magnetically attractive material sealed between two sheets of vinyl material, or between one ply of vinyl material and a sheet of cardboard, or if magnetic tokens are not used on the complementary game board or game play boards, they may be constructed of any suitable thin flat rigid or semi-rigid material, such as cardboard or plastic or cardboard covered with vinyl. In the preferred embodiment, holes are punched through the complementary game board 21 and spinners or pointers 26 are rotatably mounted therein.

A plurality of flat disc-shaped tokens 42 and 43 formed of magnetic material are used as selection indicators on the game play boards 31 and 32 and are placed on the surface of the boards during play of the game, as described hereinafter.

Figure 6:
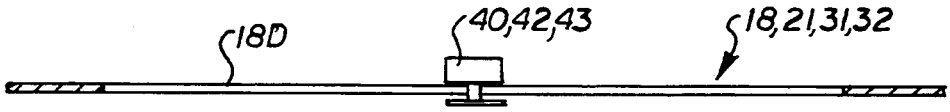
FIG. 6 is a cross section through a slotted game board member of board game apparatus.
Figure 7:
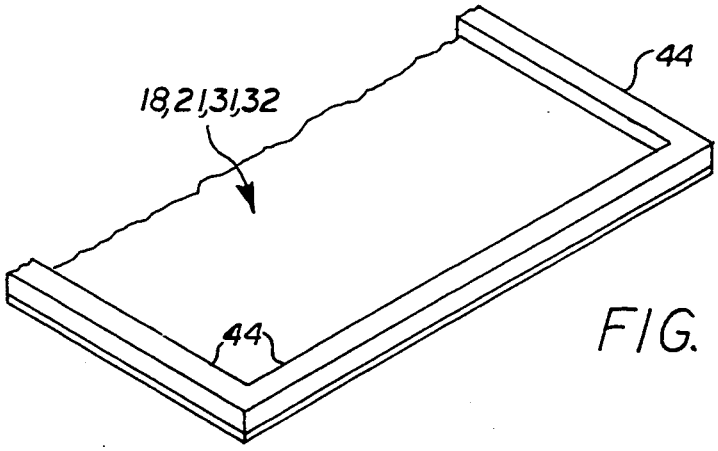
FIG. 7 is a portion of a game board having a peripheral raised border.

Alternatively, as shown in FIG. 6, the game boards 18 and 21 and game play boards 31 and 32 may be provided with slots 18D wherein the token(s) 40, 42, 42 may be permanently slidably mounted in the slots. The game boards 18 and 21 and/or play boards 31 and 32 may also be provided with a peripheral raised border 44 of a height greater than the thickness of the tokens whereby tokens on the surface of the game boards will not slide off, as shown in FIG. 7. The peripheral borders of adjacent game boards will be juxtaposed when the boards are in the closed position to enclose the tokens and prevent them from becoming lost or damaged.

A storage pouch 45 (FIG. 1) having a sealable opening 46 near one side edge and a plurality of apertures or holes 47 near another side edge corresponding to the spacing of the rings 16 of the binder 11 may also be removable received on the rings for storing loose game components, such as dice, cards, tokens, etc.

It can be seen from the foregoing description that the binder game board provides a compact easily transportable game playing system. Each binder may contain a single game or a plurality of different games.

ANOTHER PREFERRED EMBODIMENT

Referring again to FIGS. 1 and 2, a football game similar to the above described embodiment may be provided in a conventional game board construction. In other words, the outer cover or binder can be eliminated and the components packaged in a box having a lid. In this modification, the flat, rigid or semi-rigid game board member 18 would have a playing surface 20 imprinted on the outer surface for playing a football game and the previously described apertures or holes near one side edge would be eliminated. The thin, flat, rigid or semi-rigid complementary game board 21 would also be provided without the previously described apertures or holes near one side edge.

The complementary game board 21 would be imprinted with indicia and indicators 23, 24, and 25 each having a rotatably mounted pointer 26 to indicate the "DOWN" 23, the number of yards "TO GO" 24, the "QUARTER" of play 25, score boxes for "HOME" 27 and "VISITORS" 28 representing each team, and instructions 29 for carrying out the play of the game, such as rules concerning "KICK-OFF RETURN", "PUNT", and "FIELD GOAL". Depending upon the material used to construct the complementary game board 21 (described below), the players can mark the score on the surface of the game board 21 with erasable pens or markers. Paper pads may also be secured to the surface of the game board for keeping score.

The thin, flat, rigid or semi-rigid "OFFENSE" huddle board 31 and "DEFENSE" huddle board 32 having indicia imprinted thereon for carrying out the play of the game would be provided without apertures or holes near one side edge. The optional spinner 34 as previously shown and described with reference to FIGS. 1 and 4 would also be provided without apertures or holes 37 near one side edge.

The game board 18 and complementary game board 21 may be constructed of any suitable thin flat rigid or semi-rigid material, such as cardboard or plastic or cardboard covered with vinyl. Alternatively, the game board 18 may be constructed of a sheet of magnetically attractive material 18A sealed between two sheets of vinyl material 18B and 18C, or between one ply of vinyl material and a sheet of cardboard, whereby a flat token 40 representing a football formed of magnetic material may be movably attached to the outer surface and moved along the playing surface during play of the game. The game play boards 31 and 32 are preferrably constructed of a sheet of magnetically attractive material sealed between two sheets of vinyl material, or between one ply of vinyl material and a sheet of cardboard, so that a plurality of flat disc-shaped tokens 42 and 43 formed of magnetic material can be used as selection indicators on the game play boards 31 and 32 during play of the game, as described hereinafter. Alternatively, as shown in FIG. 6, the game board 18 and complementary game board 21 and game play boards 31 and 32 may be provided with slots 18D wherein the token(s) 40, 42, 42 may be permanently slidably mounted in the slots.

OPERATION

Having described the board game apparatus in a looseleaf binder binder form and conventional board game form, a method of playing a particular game utilizing the apparatus will be described with reference to the football game and binder game apparatus illustrated in FIGS. 1 and 2.

In a stored condition, the game components including the game boards 18 and 21 are all contained within the binder 11. To play the game, the binder 11 is opened, the rings 16 are opened to remove the game play boards 31 and 32 and the rings are closed. The game boards 18 and 21 are flipped over to lie flat on each side of the rings 16 adjacent one another, as seen in FIG. 2. In this position, the game board 18 having the playing surface 20 (football field) is on one side of the rings 16 and the complementary game board 21 is on the other side of the rings.

The complementary game board 21 has three circles labeled "DOWN" 23, the number of yards "TO GO" 24, and the "QUARTER" of play 25 with a pointer 26 rotatably mounted in each circle. The "DOWN" and "QUARTER" circles 23 and 25 are divided into four units labeled 1, 2, 3, and 4, and the "yards "TO GO" circle 24 is divided into four units labeled 5, 10, 15, and 20 (yards). The complementary game board 21 has score boxes for "HOME" 27 and "VISITORS" 28, representing each team. The players can mark the score on the surface of the game board 21 with erasable pens or markers, or paper pads may used for keeping score. The scoring of points is the same as in the professional game of football, i.e., 6 points for a touchdown, 3 points for a field goal, etc. The complementary game board 21 is also imprinted with instructions 29 beneath the headings; "KICK-OFF RETURN", "PUNT", and "FIELD GOAL" for carrying out the plays.

Game play begins with a toss of a coin to determine which team will kick-off and which team will receive. The receiving team places the token 40 representing the football on their 20 yard line on the playing field 20. The receiving team is now on offense and the indicator pointers 26 are set to "1st down" and "10 yds to go". The offense team receives the "OFFENSE" huddle board 31 and one selection token 42. The opposing defense team receives the "DEFENSE" huddle board 32 and four selection tokens 43.

As seen in FIG. 8, the "OFFENSE" huddle board 31 has nine offensive play options: (1) "Pass 50 Yds.", (2) "Pass 35 Yds.", (2) "Pass 25 Yds.", (3) "Pass 20 Yds.", (4) "Pass 15 Yds.", (6) "Pass 10 Yds.", (7) "Run Pitch Out 5 Yds.", (8) "Run Draw Play 5 Yds.", and (9) "Run Off Tackle 5 Yds.".

Also as seen in FIG. 8, the "DEFENSE" huddle board 32 has nine defensive stop play options: (1) "Stop Pass 50 Yds.", (2) "Stop Pass 35 Yds.", (2) "Stop Pass 25 Yds.", (3) "Stop Pass 20 Yds.", (4) "Stop Pass 15 Yds.", (6) "Stop Pass 10 Yds.", (7) "Stop Run Pitch Out 5 Yds.", (8) "Stop Run Draw Play 5 Yds.", and (9) "Stop Run Off Tackle 5 Yds.".

The "DEFENSE" huddle board 32 also has three "BLITZ" and/or "SACK" defensive play options which are used in combination with the nine defensive stop plays listed above. In selecting these "BLITZ" and/or "SACK" defensive plays, the defensive player can:

(1) Place three tokens 43 on three of the nine defensive stop play options and one token 43A on the "BLITZ" and/or "SACK" space which would represent a "10 Yd. Loss" (FIG. 10)

(2) Place two tokens 43 on two of the nine defensive stop play options and two tokens 43A and 43B on the "BLITZ" and/or "SACK" space which would represent a "Turnover" (change of possession of the football) (FIG. 11).

(3) Place one token 43 on one of the nine defensive stop play options and three tokens 43A, 43B, 43C, on the "BLITZ" or "SACK" space which would represent a "Turnover, and Return For T.D." (touchdown) (FIG. 12).

The team on offense selects one of the nine offensive plays by placing the selection token 42 on one of the nine plays on the "OFFENSE" huddle board 31, keeping the selection hidden from the opposing team. The team on defense selects four of the nine defensive stop plays by placing the selection tokens 43 on the corresponding ones of the nine plays (or in combination with the "BLITZ" an/or "SACK" options) on the "DEFENSE" huddle board 32, keeping the selection hidden from the opposing team. The goal of the defensive team is to anticipate the selection made by the offense and select the appropriate stop play(s).

After the selections have been made, both teams show their selections. If the offensive play selected was not included in the defensive stop play selections, the gain indicated on the "OFFENSE" huddle board 31 is given, and the token 40 representing the football is moved on the playing field accordingly. The "DOWN" and yards "TO GO" pointers are positioned accordingly.

FIG. 8 shows an example of a play wherein the team on offense attempted a 15 yard pass and the defense did not anticipate the play, which results in a 15 yard gain for the offense. FIG. 9 shows an example of a play wherein the offense attempted a draw play for 5 yard and the defense correctly anticipated the offensive play, which results in the play being stopped with no gain. FIG. 10 shows an example of a play wherein the offense attempted a 50 yard pass and the defense correctly anticipated the play and had one token 43A in the "BLITZ" and/or "SACK" space, which results in a 10 yard loss from the line of scrimmage for the offense. FIG. 11 shows an example of a play wherein the offense attempted a screen pass for 10 yards and the defense correctly anticipated the play and had two tokens 43A and 43B in the "BLITZ" and/or "SACK" space, which results in a turnover and change of possession. FIG. 12 shows an example of a play wherein the offense attempted a 50 yard pass and the defense correctly anticipated the play and had three tokens 43A, 43B, and 43C in the "BLITZ" and/or "SACK" space, which results in a turnover and a return for a touchdown by the defense.

When the team on offense must "PUNT", the token 40 representing the football is placed 40 yards downfield from the line of scrimmage, with no return yardage, and play resumes with the opposing team in possession.

Once the team on offense has reached the 15 yard line of the opposing team, the offense may chose to kick a field goal in which case the field goal attempt is considered to be good and the offensive team is awarded 3 points.

Optionally, a spinner 34 as seen in FIG. 4 may be provided for "FIELD GOAL" attempts which has a spinner pointer 35 rotatably mounted on a thin, flat, rigid or semi-rigid board 36 having a plurality of apertures or holes 37 near one side edge corresponding to the spacing of the rings 16 of the binder 11 such that it is releasably received on the rings and removed for carrying out the play of the game. The optional "FIELD GOAL" spinner has a circle surrounding the spinner pointer 35 divided into 8 units Four of the units are labeled "Good", one unit is labeled "Good 30 Yds or Less", one unit is labeled "Good 20 Yds or Less", one unit is labeled "Good 10 Yds or Less", and the remaining unit is labeled "Missed Field Goal".

With the "FIELD GOAL" spinner, the offensive team can attempt to kick a field goal once it has reached the 40 yard line of the opposing team by spinning the pointer. If the pointer lands on "Good", the offense is awarded 3 points. If the pointer lands on any other label, the field goal is no good. If the attempt was made at 30 yards or less, and the pointer lands on "Good" or "Good 30 yds or Less", the attempt is good, etc. The odds of a successful field goal attempt at 40 yards or less would be 4 out of 8 or 50%; for 30 yards or less, 5 out of 8 or 63%; for 20 yards or less, 6 out of 8 or 75%; for 10 yards or less, 7 out of 8 or 88%.

A quarter ends after two changes of possession have been made. Play continues until the end of the fourth quarter. After the game has been played, the rings of the binder are opened and the play boards and other game board components (spinner and storage pouch) are placed onto the binder and then secured by closing the rings.

Although a particular football board game has been described in detail, it should be understood that various other types of board games can be designed for use with the present board game apparatus.

While this invention has been described fully and completely with special emphasis upon a preferred embodiment, it should be understood that within the scope of the appended claims the invention may be practiced otherwise than as specifically described herein.

I claim:

1. Football board game apparatus for playing a football board game comprising:

an outer cover member having a central portion with releasable fastener means thereon and a pair of planar cover panels hinged along adjacent side edges to said central portion and being movable between a juxtaposed closed position and an open position laterally opposed from one another;

a game board having one side edge configured to be received on said fastener means and releasably fastened within said outer cover member, a playing surface thereon representing a football field and adapted to receive a playing token representing a football;

at least one playing token adapted to be movably positioned on said game board playing surface;

an offensive play option board having a plurality of offensive football play options imprinted on one surface thereof representing actions to be used by an offensive team to advance the football on the football field and the yardage gained thereby and selection means for selecting one of said offensive play options;

said offensive play options representing (a) "Pass 50 Yds.", (b) "Pass 35 Yds.", (c) "Pass 25 Yds.", (d) "Pass 20 Yds.", (e) "Pass 15 Yds.", (f) "Pass 10 Yds.", (g) "Run Pitch Out 5 Yds.", (h) "Run Draw Play 5 Yds.", and (i) "Run Off Tackle 5 Yds.", and a selected one of said offensive play options being selected by the offensive team during each play;

a defensive play option board having a plurality of defensive football stop play options imprinted on one surface thereof representing actions to be used by a defensive team to stop said offensive play options, to cause a loss in yardage, to change possession of the football, and to cause a turnover of said football allowing the defensive team to score a touchdown, and selection means for selecting a plurality of said defensive stop play options;

said defensive stop play options representing (a) "Stop Pass 50 Yds.", (b) "Stop Pass 35 Yds.", (c) "Stop Pass 25 Yds.", (d) "Stop Pass 20 Yds.", (e) "Stop Pass 15 Yds.", (f) "Stop Pass 10 Yds.", (g) "Stop Run Pitch Out 5 Yds.", (h) "Stop Run Draw Play 5 Yds.", and (i) "Stop Run Off Tackle 5 Yds.";

said defensive play option board including defensive football play loss options imprinted on one surface thereof to be selectively used in combination with said defensive stop play options (a) through (i) and representing (j) a "10 Yd Loss", (k) a "Turnover", and (l) a "Turnover and Return For Touchdown"; and either four of said defensive stop play options (a) through (i) being selected by the defensive team during each play, or a combination of three of said defensive stop play options (a) through (i) and one of said play loss options (j) through (k), or a combination of two of said defensive stop play options (a) through (i) and two of said play loss options (j) through (k), or a combination of one of said defensive stop play options (a) through (i) and three of said play loss options (j) through (k);

indicator means for indicating the "down", the "number of yards to go", and the "quarter of play"; and scoring means for indicating the scores of a first and second team.

2. The football board game apparatus according to claim 1 wherein said offensive play option board and said defensive play option board each have one side edge configured to be received on said fastener means and releasably fastened within said outer cover member.

3. The football board game apparatus according to claim 1 in which said game board comprises a first game board having a playing surface thereon representing a football field and adapted to receive said playing token and having one side edge configured to be received on said fastener means and releasably fastened within said outer cover member, and a second game board having said indicator means and said scoring means thereon and having one side edge configured to be received on said fastener means and releasably fastened within said outer cover member adjacent said first game board, and said first and second game boards being disposed face to face when said cover member is closed, and when opened, said first and second game boards are positioned to lie in a flat face up position on each side of said fastener means adjacent one another for carrying out the play of a game.

4. The football board game apparatus according to claim 1 wherein said offensive play option board and said defensive play option board each comprise a stiff sheet of magnetically attractive material, and said selection means comprises at least one token formed of magnetic material and is magnetically engaged for movement on said offensive play option board and said defensive play option board.

5. The football board game apparatus according to claim 4 wherein said game board comprises a stiff sheet of magnetically attractive material, and said playing token is formed of magnetic material and is magnetically engaged for movement on said at least one game board playing surface.

6. The football board game apparatus according to claim 1 including spinner means for determining the outcome of a field goal attempt by the offensive team, said spinner means having a pointer rotatably mounted in a circle divided into 8 units, four of said units labeled "Good", one of said units labeled "Good 30 Yds or Less", one of said units labeled "Good 20 Yds or Less", one of said units labeled "Good 10 Yds or Less", and the remaining unit labeled "Missed Field Goal", whereby, the offensive team upon having reached or passed the 40 yard line of the opposing team can choose to attempt to kick a field goal by spinning the pointer, and if the pointer stops on the unit labeled "Good" or if the attempt was made within the range of the unit on which the pointer stops, the offensive team is given points for a successful field goal, and if the pointer stops on the unit labeled "Missed Field Goal" on any unit beyond the range at which the attempt was made, the field goal attempt is no good, such that the odds of a successful field goal attempt at 40 yards or less would be approximately; 4 out of 8 or 50% for 40 yards or less, 5 out of 8 or 63% for 30 yards or less, 6 out of 8 or 75% for 20 yards or less, 7 out of 8 or 88% for 10 yards or less.

7. A method for playing a football game comprising the steps of:

providing a game board having a playing surface thereon representing a football field and adapted to receive a playing token representing a football, at least one playing token adapted to be movably positioned on said game board playing surface, an offensive play option board having a plurality of offensive football play options imprinted on one surface thereof representing actions to be used by an offensive team to advance the football on the football field and the yardage gained thereby and selection means for selecting one of said offensive play options, a defensive play option board having a plurality of defensive football play options imprinted on one surface thereof representing actions to be used by a defensive team to stop said offensive play options, to cause a loss in yardage, to change possession of the football, and to cause a turnover of said football allowing the defensive team to score a touchdown, and selection means for selecting a plurality of said defensive play options, indicator means for indicating the "down", the "number of yards to go", and the "quarter of play", and scoring means for indicating the scores of a first and second team;

tossing a coin to determine the team to receive the football, and placing the playing token representing the football on the football field at the 20 yard line of the receiving team upon initial kick-off;

issuing said offensive game play option board to the receiving team which then becomes the offensive team and issuing said defensive game play option board to the opposing team which becomes the defensive team;

the offensive team selecting one of said offensive play options while keeping the selection hidden from the defensive team and the defensive team attempting to anticipate the selection made by the offensive team and selecting several said defensive play options to stop the anticipated offensive play while keeping the selection hidden from the offensive team; and after the selections have been made, both teams exposing their selections and if the offensive play selected was not included in the several defensive play option selections made by the defensive team, the gain in yardage indicated on said offensive game play option board is given to the offensive team and said token representing the football is moved on the playing field accordingly and the "down" and "yards to go" indicators are changed accordingly; and if the offensive play selected was included in the several defensive play option selections made by the defensive team, the selected offensive play is either; stopped and no yardage is given to the offensive team, the offensive play is stopped and a loss of yardage is given to the offensive team, or the possession of the football is changed, or the defensive team recovers possession of the football and is given points for scoring a touchdown, and the "down" and "yards to go" indicators are changed accordingly;

upon the offensive team having reached a predetermined yard line of the defensive team, the offensive team being allowed the choice of kicking a field goal and upon so choosing is given points for scoring a field goal;

upon the offensive team having reached a predetermined "down", the offensive team being allowed the choice of punting the football and upon so choosing, said playing token being placed a predetermined number of yards from the line of scrimmage and play resumes with the opposing team in possession of the football and no return yardage being given;

said indicator means for indicating the "quarter of play" being changed at the end of two offensive plays being stopped by the defensive team; and play of the game being ended upon the end of the fourth quarter.

8. Apparatus for playing a board game comprising;

an outer cover member having a central portion with releasable fastener means thereon and a pair of planar cover panels hinged along adjacent side edges to said central portion and being movable between a juxtaposed closed position and an open position laerally opposed from one another, at least one game board having a playing surface thereon for playing a game and having one side edge configured to be received on said fastener means and releasably fastened within said outer cover member, said at least one game board adapted to receive at least one playing token for movement on said playing surface, at least one playing token adapted to be movably positioned on said at least one game board playing surface for carrying out the play of the game, and a storage pouch having one side edge configured to be received on said fastener means and releasably fastened within said outer cover member for use in storing loose game components used in carrying out the play of the game.

9. The apparatus according to claim 8 in which said at least one game board comprises a first game board having a playing surface thereon for playing a game and having one side edge configured to be received on said fastener means and releasably fastened within said outer cover member, and a second game board having one side edge configured to be received on said fastener means and releasably fastened within said outer cover member adjacent said first game board, such that said first and second game boards are disposed face to face when said cover member is closed, and when opened, said first and second game boards are positioned to lie in a flat face up position on each side of said fastener means adjacent one another for carrying out the play of a game.

10. The apparatus according to claim 9 wherein said second game board has a playing surface thereon complementary to the playing surface of said first game board for carrying out the play of a game.

11. The apparatus according to claim 8 wherein said at least one game board comprises a stiff sheet of magnetically attractive material, and said at least one playing token is formed of magnetic material and is magnetically engaged for movement on said at least one game board playing surface.

12. The apparatus according to claim 8 wherein said at least one said game board comprises a stiff sheet of material having a slot therein, and said at least one playing token is configured to be slidably engaged in said slot for movement on said at least one game board playing surface.

13. The apparatus according to claim 8 including chance means having one side edge configured to be received on said fastener means and releasably fastened within said outer cover member for use in carrying out the play of the game.

14. The apparatus according to claim 13 wherein said chance means comprises a spinner rotatably mounted on a sheet of rigid material having one side edge configured to be received on said fastener means and releasably fastened within said outer cover.

15. The apparatus according to claim 8 including at least one game play option board having one side edge configured to be received on said fastener means and releasably fastened within said outer cover member and having a plurality of game playing options imprinted on one surface thereof, game play selection means on said at least one game play board for selecting a said game play option, said at least one game play option board being used in cooperation with said at least one game board for carrying out the play of the game.

16. The apparatus according to claim 15 comprising a first game play option board having one side edge configured to be received on said fastener means and releasably fastened within said outer cover member and having a plurality of offensive game playing options imprinted on one surface thereof, and selection means on said first game play board for selecting one of said offensive game play options, a second game play option board having one side edge configured to be received on said fastener means and releasably fastened within said outer cover member and having a plurality of defensive game playing options imprinted on one surface thereof, and selection means on said second game play board for selecting at least one of said defensive play options, said first and second game play option boards being used in cooperation with one another and with said at least one game board for carrying out the play of the game.

* * * * *